US007201440B2

(12) United States Patent
Heck et al.

(10) Patent No.: US 7,201,440 B2
(45) Date of Patent: Apr. 10, 2007

(54) HIGH CHAIR TRAY ADAPTED TO RECEIVE RECEPTACLES

(76) Inventors: Jodi L. Heck, 1412 Appleton Ct., Arnold, MO (US) 63010; Joseph A. Heck, III, 1412 Appleton Ct., Arnold, MO (US) 63010

( * ) Notice: Subject to any disclaimer, the term of this patent is extended or adjusted under 35 U.S.C. 154(b) by 0 days.

(21) Appl. No.: 10/913,032

(22) Filed: Aug. 6, 2004

(65) Prior Publication Data

US 2005/0029840 A1 Feb. 10, 2005

Related U.S. Application Data

(60) Provisional application No. 60/493,326, filed on Aug. 8, 2003.

(51) Int. Cl.
*A47B 39/00* (2006.01)

(52) U.S. Cl. ..... 297/148

(58) Field of Classification Search ..... 297/153, 297/154, 155, 148, 149, 150, 151, 152, 135, 297/217.1, 188.2, 188.01; 108/26.2, 26, 108/25; 403/202, 381, 349
See application file for complete search history.

(56) References Cited

U.S. PATENT DOCUMENTS 2,684,110 A * 7/1954 Stone ..... 297/154
3,586,368 A * 6/1971 Guild ..... 297/135
4,532,672 A * 8/1985 Anderson ..... 16/86 A
4,908,066 A * 3/1990 Taylor et al. ..... 108/26
4,927,024 A * 5/1990 Lloyd ..... 206/562
5,975,628 A * 11/1999 Russell ..... 297/135
6,179,377 B1 * 1/2001 Harper ..... 297/148
6,216,605 B1 * 4/2001 Chapman ..... 108/26
2002/0178975 A1 * 12/2002 Lewis et al. ..... 108/90

* cited by examiner

*Primary Examiner*—Milton Nelson, Jr.
(74) *Attorney, Agent, or Firm*—Charles McCloskey

(57) ABSTRACT

A tray connects with various high chairs and securely attaches various food receptacles to resist knocking over by a small child or toddler seated within the high chair. The tray has an annular slot with curved wider and curved narrower slots in alternating sequence. A complementary curved channel, located beneath each slot, communicates with each cooperating narrower slot and adjacent wider slots. Food receptacles, such as bowls, plates, and the like are releasably attached to the tray over the annular slot. Each food receptacle contains curved anchor members located on the bottom in a circular pattern complementary to the annular slot. The infirm and the elderly may also benefit from this tray.

3 Claims, 3 Drawing Sheets

HIGH CHAIR TRAY ADAPTED TO RECEIVE RECEPTACLES

CROSS REFERENCE TO RELATED APPLICATION

This non-provisional patent application claims priority to the provisional application for patent having Ser. No. 60/493,326, which was filed on August 8, 2003.

BACKGROUND OF THE INVENTION

This version of the invention relates to high chairs for small children and toddlers, and specifically to trays that receive in locking engagement food receptacles so as to prevent the food receptacles from being separated from the tray by the actions of a small child or toddler seated in the high chair.

Small children and toddlers require the use of a specially designed high chair during the age period when they are learning to eat and drink as an adult. During this phase of childhood, a small child is making the transition from taking liquid nourishment such as baby formula to taking nourishment in the manner of an adult in which the small child is placed in an upright seated position and served solid and liquid nourishment in a variety of receptacles, such as bowls, plates, cups, and the like. A typical high chair simulates for the small child the experience of eating at a table as the high chair provides a seat and a tray supported by arm members so as to maintain the tray in a position adjacent to the seat. The tray functions as a table top or counter top upon which food receptacles and utensils are normally placed.

During this transitional phase, it is common for small children to knock food receptacles over, spilling their contents onto the tray or the adjacent floor surface, or knock food receptacles and utensils completely off the tray. This behavior may be the result of a variety of causes, such as the child becoming agitated or uncomfortable being seated in the high chair, disliking the food being served, or becoming frustrated with the task of learning to handle, manipulate, or otherwise use the food receptacles and utensils. In any event, the parent, guardian, or caregiver must ensure that the small child does not separate food receptacles and utensils from the tray so that the child can learn how to eat like an adult and to take the full serving of nourishment provided on the tray to satisfy the daily nutritional requirement.

What is needed then to overcome the aforementioned disadvantages of conventional high chairs and food receptacles designed for use by children taking nourishment while seated in a high chair is the provision of a high chair tray adapted to receive a variety of attachable food receptacles? The food receptacles may be configured as bowls, plates, and the like and can be secured to the top surface of a high chair tray so as to withstand any action by a small child, action that would knock over, tumble, or otherwise position a food receptacle making it unable to perform its intended function of storing and presenting food to the child upon the high chair tray.

DESCRIPTION OF THE PRIOR ART

A variety of high chairs and food receptacles and utensils have been provided in the prior art to prevent the mishaps that occur when children are learning to take nourishment while seated within a high chair. For instance, food receptacles are available with detachable covers and lids so as not to spill their contents when knocked over or off of the high chair tray. High chairs with modified trays are available wherein various food receptacles can be releasably attached to the high chair or high chair tray. Even though these designs may be suitable for the specific individual purposes to which they address, they would not be suitable for the purposes of the present version of the invention as such designs are generally cumbersome to use or do not afford the versatility necessary to function with a variety of common food receptacles, such as plates and bowls. These designs are exemplified by U.S. Pat. No. 4,908,066, issued to Taylor et al.; U.S. Pat. No. 4,927,024, issued to Lloyd; U.S. Pat. No. 5,010,826, issued to Kudlac; U.S. Pat. No. 5,087,097, issued to Hehn; U.S. Pat. No. 5,586,800, issued to Triplett; and U.S. Pat. No. 6,283,042, issued to Wargo. The Kudlac design requires use of static retainers, which are part of the tray of a high chair and to lock a food receptacle to the tray. The static retainers are inserted within openings formed in the tray to hold specially-designed food receptacles within the openings of the tray. The static retainers, once separated from the tray, are subject to becoming lost or misplaced. Furthermore, care must be exercised to properly align the static retainers within the openings of the tray otherwise the food receptacle would not be adequately secured to the tray. In another embodiment of the Kudlac design, clips are located on the top surface of the tray. The clips receive arm members of a food receptacle in order to secure the food receptacle to the top surface of the tray. During non-use of the food receptacle, the clips are exposed on the top surface of the tray and may snag, cut, or otherwise injure the hand and arm of a young child while the child is seated within the high chair.

As such, it may be appreciated that there is a need for a high chair tray that receives a variety of attachable food receptacles that when secured thereon resist separation from the high chair tray, knocking over, or otherwise rendered unusable by a child seated in a high chair. The food receptacles are provided as plates, bowls, or the like commonly used to feed small children seated in high chairs. The present invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and non-obvious combination of method steps and component elements, with the use of a minimum number of functioning parts, at a reasonable cost to manufacture, and by using readily available materials.

SUMMARY OF THE INVENTION

The present version of the invention relates to the field of high chairs for small children and toddlers. More specifically, this version of the invention is concerned with high chair trays that receive food receptacles in locking engagement to prevent them from being separated from the tray by a small child or toddler seated in the high chair. The present invention overcomes all of the shortcomings listed previously, in addition to novel aspects that will be described in detail hereinafter.

Described briefly, the invention presents a tray that affixes to various high chairs so as to provide the means by which various food receptacles can be securely attached to the tray so the receptacles will remain fixed while a small child or toddler is seated within the high chair. The tray contains an annular slot located medially on the top side thereof. The annular slot is comprised of three semi-circular wider slots and three semi-circular narrower slots. The wider slots and narrower slots are disposed in alternating sequence. A semi-circular channel is located beneath each narrower slot and communicates with each cooperating narrower slot and adjacent wider slots. The wider slots, narrower slots, and channels possess identical arc length, and the wider slots and channels possess identical width.

Food receptacles, or dishware, in various shapes and configurations, such as bowls, plates, and the like are releasably attached to the tray over the annular slot thereof. Each food receptacle contains three semi-circular anchor members located on the bottom side thereof. The anchor members are located in a circular pattern commensurate with the annular slot of the tray and an equidistant relation so that a gap is located on opposed sides of any anchor member. Each anchor member has a semi-circular narrower member and a semi-circular wider member. A food receptacle attaches to the tray by aligning the receptacle over the annular slot thereof and inserting the anchor members of the food receptacle into the wider slots of the annular slot and rotating the food receptacle clockwise until the anchor members are fully received by the narrower slots and adjoining channels. At this point, the food receptacle is locked in place to the tray. The food receptacle can be separated from the high chair tray by rotating the food receptacle counterclockwise until the anchor members again occupy the wider slots at which time the food receptacle can be separated from the high chair tray.

The present invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

Numerous objects, features and advantages of the present invention will be readily apparent to those of ordinary skill in the art upon a reading of the following detailed description of presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

Accordingly, it is an object of the present invention to provide a low cost and easily manufactured and marketed tray adapted to receive attachable food receptacles.

A further object of the present invention is to provide a ready to use and versatile tray adapted to receive attachable food receptacles.

A further object of the invention is to provide a tray adapted to receive attachable food receptacles, the tray having slots that interlock various food receptacles, each food receptacle having on the bottom thereof three semi-circular anchor members, each anchor member separated by a distance commensurate with each anchor member.

A further significant object of the invention is to provide a tray adapted to receive attachable food receptacles that withstand any action by a small child, which would knock over, tumble, or otherwise prevent a food receptacle from storing and presenting food to the child.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

Figure 1:
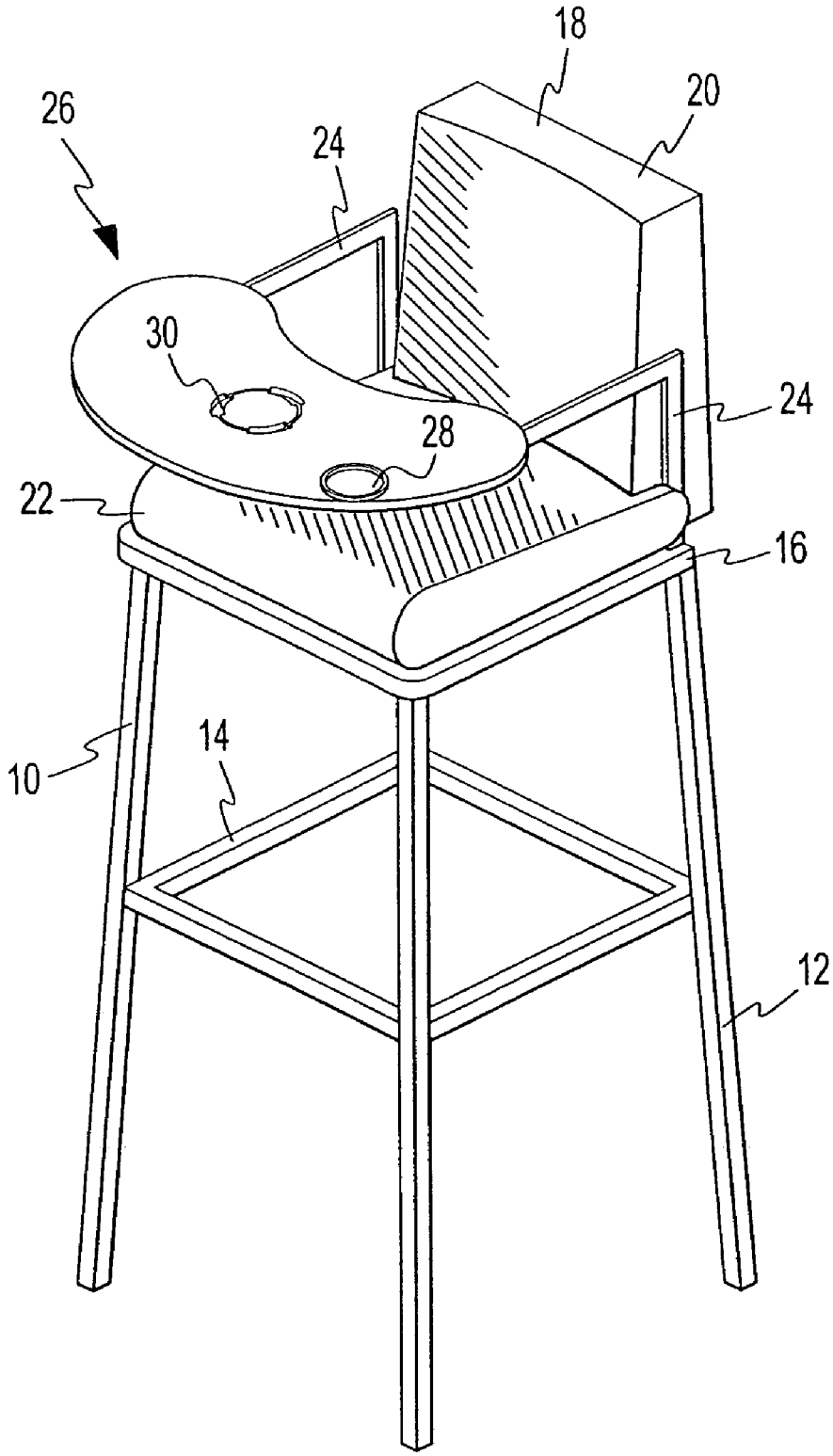
FIG. 1 is a perspective view of the preferred embodiment of a tray adapted to receive attachable food receptacles, the tray affixed to a high chair in accordance with the present version of the invention.

It will become more fully understood from the following description of the preferred embodiment of the invention as illustrated in the accompanying drawings in which like reference characters refer to the same parts throughout the various figures. The drawings are not necessarily to scale, emphasis instead being placed upon illustrating the principles of the invention.

DESCRIPTION OF THE PREFERRED EMBODIMENT

The present art overcomes the prior art limitations by providing separate pieces for printing and assembly. Referring now to the drawings and, in particular, to FIG. 1 wherein there is illustrated a typical embodiment of a conventional high chair 10 for children. The high chair 10 is comprised of a series of elongate leg members 12 that are secured in place by a lower brace 14 and an upper brace 16. A seat 18 is attached onto the upper brace 16 and is comprised of a seat back 20 and a seat bottom 22. Arm members 24 are attached to opposite sides of the seat 18 at the junction of the seat back 20 and seat bottom 22. A tray 26 adapted to receive attachable food receptacles is affixed to the arm members 24 on the ends opposite to the seat 18. The means of attaching the tray 26 to the arm members 24 comprises a variety of methods and techniques well known in prior art and designs, such as threaded screw fasteners, rivets, welding, and the like. A cup holder 28 is located on the top of the tray 26 adjacent to a side thereof, and an annular slot 30 is located in the medial portion of the tray 26.

Figure 2:
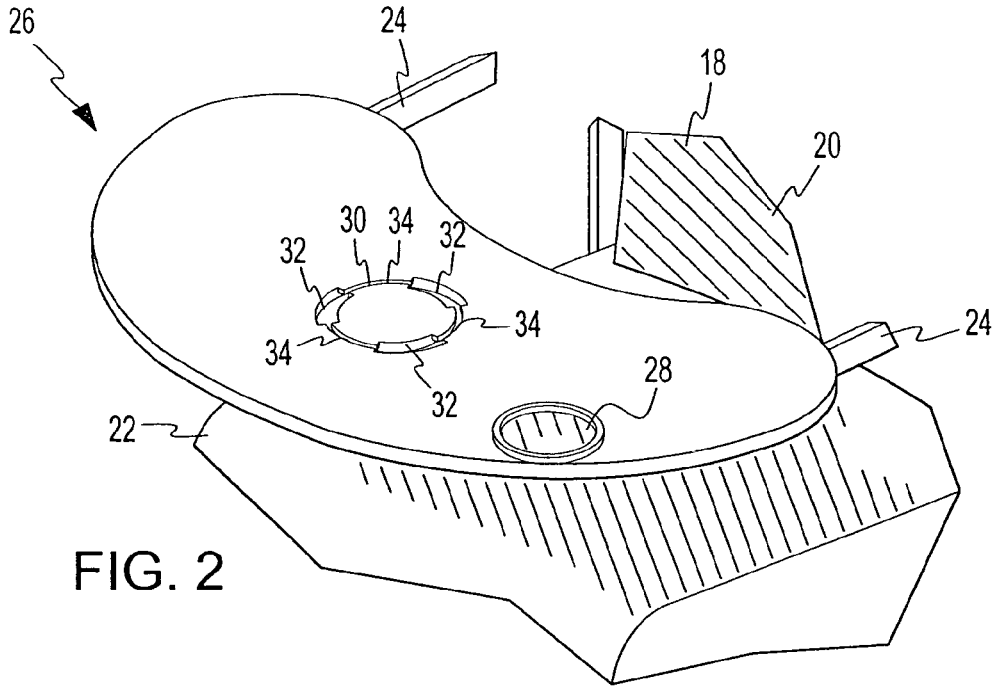
FIG. 2 is a detailed perspective view of the preferred embodiment of the tray affixed to a high chair.

As shown in detail in FIG. 2, the annular slot 30 is comprised of three semi-circular wider slots 32 and three semi-circular narrower slots 34. The slots 32, 34 are disposed in an alternating pattern so that any wider slot 32 is flanked on opposite ends by narrower slots 34, and any narrower slot 34 is flanked on opposite ends by wider slots 32. When combined, the individual slots 32, 34, form the complete annular slot 30.

Figure 3:
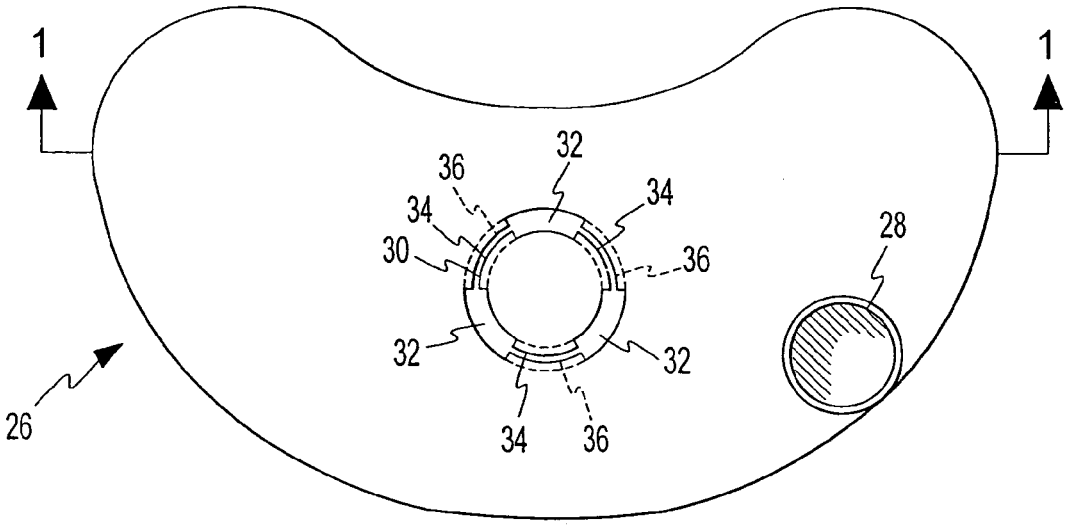
FIG. 3 is a top view of the preferred embodiment of the tray adapted to receive attachable food receptacles.
Figure 4:
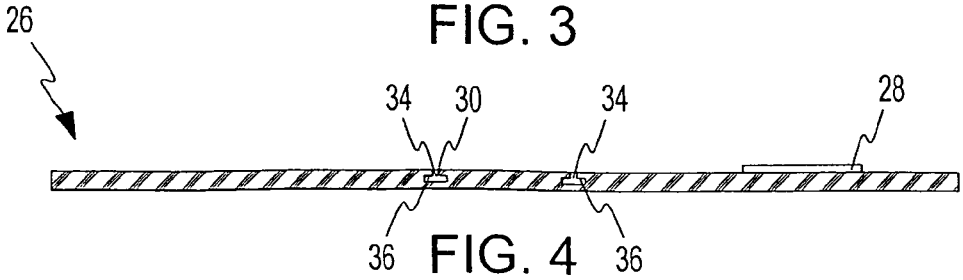
FIG. 4 is a partial cross-sectional view of the preferred embodiment of the present invention adapted to receive attachable food receptacles taken along line 1—1 of FIG. 3.

Referring to FIG. 3, the tray 26 appears in plan view. A semi-circular channel 36 is located beneath each narrower slot 34 and has the same width as a wider slot 32. When viewed in cross section as in FIG. 4, the depth of a narrower slot 34 and the depth of a channel 36 comprises approximately one-third the thickness of the tray 26. A narrower slot 34 and cooperating channel 36 are disposed in perpendicular relation so that said slot 34 and cooperating channel 36 form an inverted T shape. The wider slots 32, narrower slots 34, and channels 36 possess identical arc length so that said slots 32, 34 and channels 36 are equidistant. Furthermore, the wider slots 32 and channels 36 possess identical width.

Figure 5:
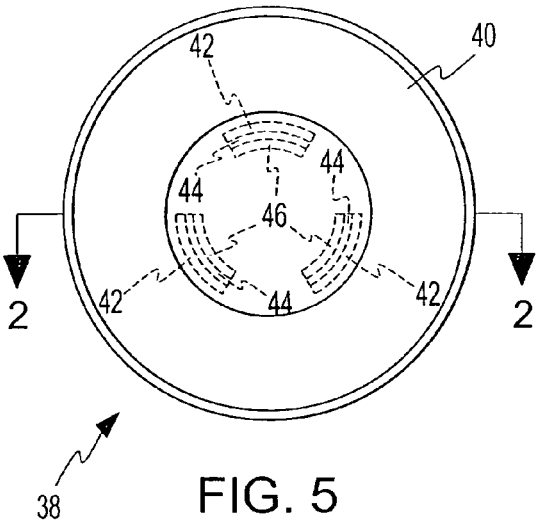
FIG. 5 is a top view of an attachable food receptacle configured as a bowl.
Figure 6:
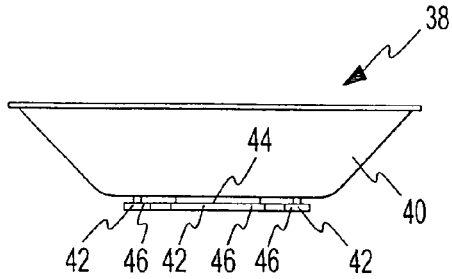
FIG. 6 is a side view of an attachable food receptacle configured as a bowl taken along line 2—2 of FIG. 5.
Figure 7:
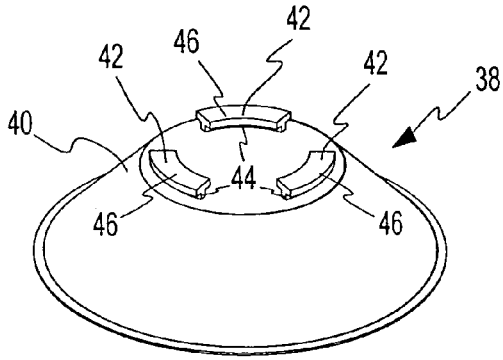
FIG. 7 is a bottom perspective view of an attachable food receptacle configured as a bowl.

A detachable food receptacle, or dishware, configured as a bowl 38 is illustrated in FIGS. 5–7. The bowl 38 is circular in shape and has a bottom 40 with a concave top to hold food. Three semi-circular anchor members 42 (shown in phantom, FIG. 5) are located on the bottom of the bowl 38. The anchor members 42 and the distance separating any two anchor members 42 comprise the same arc length so that said anchor members 42 are equidistant. Each anchor member 42 is comprised of a narrower semi-circular member 44 and an adjoining wider semi-circular member 46. The narrower member 44 is connected on a first side thereof to the bottom of the bowl 38 and on a second side thereof to a cooperating wider member 46. The wider member 46 is disposed in perpendicular relation to an adjoining narrower member 44. The length of arc of any narrower member 44 and cooperating wider member 46 are identical, and their combined arc length is identical to the arc length of wider slot 32 and narrower slot 34 of the tray 26. Furthermore, the width of any wider member 46 is identical to the width of any wider slot 32 of the high chair tray 26, and the width of any narrower member 44 is identical to the width of any narrower slot 34 of the tray 26. In other embodiments, the food receptacle may be provided as a plate of varying diameter or shape, and the like.

Figure 8:
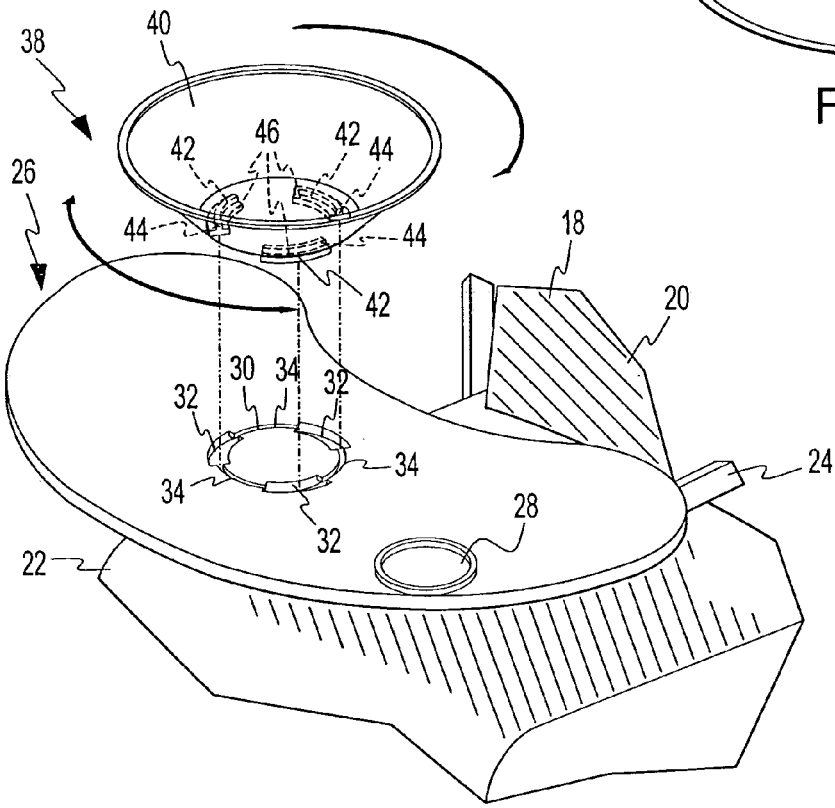
FIG. 8 is a detailed perspective view of an attachable food receptacle configured as a bowl aligned over the preferred embodiment of the present invention; and, FIG. 9 is a top perspective view of a detachable cover to be fitted over the annular slot of the high chair tray.
Figure 9:
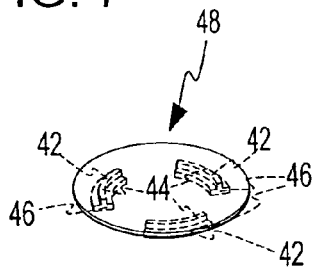

As shown in FIG. 8, the bowl 38 is positioned above the annular slot 30 of the tray 26 for releasable attachment thereon. Each anchor member 42 is aligned directly over a cooperating wider slot 32. When the bowl 38 is lowered and makes contact with the top of the high chair tray 26, the anchor members 42 insert into cooperating wider slots 32. The bowl 38 locks into position upon the tray 26 by being rotated clockwise so that the narrower member 44 and wider member 46 of any anchor member 42 occupy an adjacent narrower slot 34 and adjoining channel 36 respectively. The anchor members 42 of the bowl 38, received by the narrower slots 34 and adjoining channels 36, affix the bowl 38 to the top of the tray 26 and prevent the bowl 38 from becoming tumbling or otherwise separating from the tray 26 over the annular slot 30 thereof. The bowl 38 can be removed from the tray 26 by rotating counterclockwise until the anchor members 42 fully occupy the wider slots 32 where the bowl 38 can be lifted up from the annular slot 30.

During non-use of the high chair 10, a cover 48 can be releasably attached to the tray 26 over the annular slot 30. The cover 48 includes three anchor members 42, each of which are comprised of narrower members 44 and adjoining wider members 46. The anchor members 42 possess the identical arc length, width, and spacing between members 42 as the anchor members of the food receptacle 38. The cover 48 can be attached to the tray 26 over the annular slot 30 thereof as described previously for the bowl 38 so as to prevent dirt or debris from accumulating within the wider slots 32, narrower slots 34, and channels 36 of the annular slot 30. Furthermore, the cover 48, when attached to the tray 26 as described, provides the tray with a smooth surface that does not snag or injure the hands and arms of a child seated within the high chair.

While this version of the invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

From the aforementioned description, a high tray chair adapted to receive food receptacles has been described. The high chair tray is uniquely capable of securing matching dishware to the tray. The high chair tray and its various components may be manufactured from many materials including but not limited to polymers, high density polyethylene, polypropylene, polyethylene terephalate ethylene, nylon, ferrous and non-ferrous metals, their alloys, and composites.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. A device adapted to be secured to a chair for infants, comprising:

a tray having a planar shape to span across said chair;

a plurality of dishware sized to fit upon said tray;

at least two slots upon said tray and at least two complementary anchor members upon said dishware, said slots partially circumscribing said dishware and releasably securing said dishware upon said tray;

a cover cooperating with said slots;

said slots having a generally inverted T shape; and, said anchor members having a complementary inverted T shape;

whereby said dishware when said anchor members engage said slots resists upsetting by an occupant of the chair.

2. The securing device of claim 1 further comprising:

three of said slots being generally arcuate and in a spaced equiangular arrangement upon said tray; and, three of said anchor members being generally arcuate and in a spaced equiangular arrangement upon said dishware and said cover;

whereby said slots and said anchor members attain a geometric shape in plan view and said slots and said anchor members interlock when said dishware turns upon said tray.

3. The securing device of claim 2 wherein said slots and said anchor members are arranged in a round shape.

* * * * *